United States Patent [19]

Loda

[11] Patent Number: 4,499,405

[45] Date of Patent: Feb. 12, 1985

[54] HOT CATHODE FOR BROAD BEAM ELECTRON GUN

[75] Inventor: Gary K. Loda, Danville, Calif.

[73] Assignee: RPC Industries, Hayward, Calif.

[21] Appl. No.: 265,462

[22] Filed: May 20, 1981

[51] Int. Cl.[3] ..... H01J 29/50; H01J 31/00

[52] U.S. Cl. ..... 315/13.1; 313/302; 313/446

[58] Field of Search ..... 315/13 R, 30 R, 383, 315/13.1; 313/302, 304, 336, 351, 446

[56] References Cited

U.S. PATENT DOCUMENTS

| | | | |
|---|---|---|---|
| 1,949,048 | 2/1934 | Holst | 315/336 |
| 2,148,588 | 2/1939 | Snow | 313/446 |
| 3,374,386 | 3/1968 | Charbonnier et al. | 313/446 |
| 3,626,231 | 12/1971 | Kahl | 313/446 |
| 3,863,163 | 1/1975 | Farrell et al. | 328/233 |

*Primary Examiner*—Theodore M. Blum
*Attorney, Agent, or Firm*—Limbach, Limbach & Sutton

[57] ABSTRACT

An improved broad beam electron gun having a hot cathode assembly which is comprised of cathode means for generating a substantially hemispherical space-charge distribution, the cathode means including electron emitting structures having principal electron emissive surfaces which lie in hypothetical cylindrical-shaped surfaces, the axes of revolution of which are coincident with the major axis of symmetry of the electron emitting structure, the major axis of symmetry being orthogonal to the plane of the anode, the electron emitting structures variously including concave filament sections which form a tip, cylinders and coils, and wherein an electron beam of broad, uniform cross-sectional area is obtained without a shaping grid.

14 Claims, 11 Drawing Figures

HOT CATHODE FOR BROAD BEAM ELECTRON GUN

BACKGROUND OF THE INVENTION

This invention relates generally to broad beam electron guns and, in particular, to an improved hot cathode for broad beam electron guns. In the past, broad beam electron guns have called for the use of a shaping grid for regulating the dispersal of electrons being emitted from hot cathodes. Reference is made to Farrell, et al. U.S. Pat. No. 3,863,163, wherein a plurality of elongated filament cathodes are spaced apart and parallel to each other in a common plane and shaping grids having the shape of half-cylinders are disposed about the cathode filaments. An electrical potential is applied between the filament and the shaping grid so that electrons emitted from the cathode filaments are attracted toward the shaping grid in a corresponding pattern. A second potential is applied between the shaping grid and the anode so that after the electrons are attracted toward the shaping grid, they are then accelerated toward the anode with the desired energy level. The dispersal pattern created by the shaping grid provides the desired large cross-sectional area electron beam.

In other devices where multiple cathodes have been used, but without a shaping grid, the electron beams obtained did not have a uniform cross-sectional intensity.

While the use of a shaping grid provides the desired uniform beam intensity and large cross-sectional area, the addition of a shaping grid to an electron gun apparatus gives rise to additional complexity, added parts requirements, configuration modifications, as well as higher costs.

The elongated filaments used in Farrel present additional, practical problems. In Farrell, long filament lengths were required to obtain the broad electron beam cross-sections. For example, a 10-centimeter beamwidth requires a minimum of 10-centimeter filament lengths. Shorter filaments would be unsatisfactory since there is insufficient electron emission in the area of the ends of each filament in a direction parallel to the axis of the filament. Long filament lengths are difficult to physically support within the electron gun housing. As evidenced by the material in Farrell, additional parts are required to compensate for thermal expansion of the elongated filament, otherwise, sagging and resulting misalignment of the filament occur which, in turn, affect the uniformity of the electron beam. Additionally, long filament lengths require more power to operate than do filaments of shorter length.

Additionally, in the past, multiple cathode configurations used in broad beam electron guns often required precise geometries. This requirement arose because the broad electron beam was generated by summing a number of individual, narrow electron beams which were independent of one another. The parameters for each beam were such that the self-fields between the beams had insignificant effect upon the characteristics of the resulting broad beam. Therefore, any non-uniformity in any particular narrow beam caused a corresponding non-uniformity in the broad electron beam.

Under the above conditions, the spacings between cathode filaments, as well as the geometries of each cathode filament must be maintained with precision; otherwise, imbalances in beam cross-sectional distribution, as well as beam intensity, will occur. If, for example, a particular cathode had dimensions different from adjacent cathodes, the electron distribution pattern in the area corresponding to the differently dimensioned cathode would be different from the distributions in areas where the cathodes were of uniform dimension.

Thus, in multiple cathode broad beam electron guns of the past, precise geometries in the cathode configurations were necessary for satisfactory performance.

SUMMARY OF THE INVENTION

The foregoing and other problems of prior art broad beam electron guns are overcome by the present improved broad beam electron gun of the type having a vacuum-tight housing, an anode, generally transparent to electrons, a cathode assembly which is operated in a space-charge-limited mode and which is parallel to and spaced apart from the anode assembly to form an unobstructed chamber between the cathode assembly and the anode assembly, and means for applying an electrical potential between the cathode assembly and the anode, wherein the improvement includes cathode means, positioned within the cathode assembly, for generating a substantially hemispherical space charge distribution within the cathode assembly. The cathode means include an electron emitting structure which has a major axis of symmetry and also principal electron emissive surfaces which are contained within a hypothetical cylindrically-shaped surface whose axis of revolution is coincident with the major axis of symmetry of the electron emitting structure. The electron emitting structure is positioned so that its major axis of symmetry is orthogonal to the plane of the anode assembly.

One embodiment of the present invention includes cathode structures which are concave, "u" (or hair-pin) shaped filaments. The "u" of hair-pin shaped cathode filaments are each concave and have a tip. The cathodes are arranged with tips pointing toward the anode assembly. The cathodes are arrayed in a single hypothetical plane which is perpendicular to the plane of the anode assembly. In another embodiment the cathode filaments are each contained in separate, parallel hypothetical planes which are perpendicular to the plane of the anode. Other embodiments include a number of parallel rows of the cathodes arranged in the single hypothetical plane or parallel hypothetical plane configurations indicated above. There is no requirement for a shaping grid and thus there are none of the control and operating requirements associated with the use of a shaping grid.

Other cathode shapes which provide the requisite space charge distribution include cylinders, and coils.

As used in this application, a "major axis of symmetry" is defined as the longest axis of symmetry, where an axis of symmetry is defined as a line about which a structure is symmetric. Similarly, an "axis of revolution" is defined as the straight line through all fixed points of a rotating rigid structure around which all other points of the body move in circles. "Principle electron emissive surfaces" are defined as the surfaces from which a substantial proportion (for example, greater than 60%) of the available electrons are emitted. "Space charge distribution" refers to the electrical field distribution produced by the emitted electrons.

For example, a cathode structure having the shape of a hair-pin has a single axis of symmetry, the line which runs through the midpoint of the gap between the ends of the legs and through the center of the lip. This axis is deemed the major axis of symmetry. The hypothetical, cylindrically-shaped surface which contains the electron emissive surfaces of the hair-pin structure is defined by rotating the hair-pin structure about its major axis of symmetry to inscribe two concentric, hypothetical cylinders, between which are included all cylindrical surfaces which contain the principal electron emissive surfaces of the hair-pin structure and which also have axes of rotation which are coincident with the major axis of symmetry of the hair-pin structure.

As to a cylindrically-shaped cathode structure, the major axis of symmetry is the longitudinal axis of the cylinder. The hypothetical, cylindrically-shaped surface which contains the principal electron emissive surfaces of the cylindrical structure is defined by the side walls of the structure. When the length of the cylindrical structure is long with respect to the diameter of the structure, it can be seen that greater than 60% of the available electrons will be emitted from the side walls of the structure, rather than the top or the bottom of the structure.

With respect to the coil shaped structure, the major axis of symmetry is the longitudinal axis of the coil. The hypothetical, cylindrically-shaped surface which contains the principal electron emissive surfaces of the coil structure is the cylindrical surface having its longitudinal axis coincident with the major axis of symmetry of the coil structure, and also whose surface contains the outer radial edges of the coil structure.

In the present invention, the cathode means operate in a "space charge limited" mode. In a space charge limited mode, the number of electrons which are drawn away from the cathodes is determined by the electrical, accelerating voltage (or electrical potential between the anode and cathode assemblies) used. Under these conditions, the "self" field of each electron has great effect on the electron beam density and distribution. In the area adjacent to the cathode, the path of an emitted electron is determined by the electric fields, or "self" fields, which are generated by adjacent electrons, as well as the kinetic energy imparted to it upon emission from the cathode. Under these conditions, the uniformity of the electron beam cross-sectional area is very tolerant of the geometries of the particular cathode configurations. The primary influencing factor providing the large areal distribution of electrons is the general shape of the particular cathodes used. In the present invention, so long as the cathodes are shaped so that electrons emitted from each cathode have emission paths with a substantial initial velocity component transverse to, or perpendicular to, the electrical potential which draws the electrons away from the cathodes, the cathode spacing and shape need not be precise.

In a still further embodiment of the invention, a generally planar control grid, which is disposed in a plane parallel to the anode assembly, is used to regulate the beam intensities emitted from the electron gun. While an electron beam having large, uniform, cross-sectional area can be generated without the use of such a control grid, the current densities generated in absence of such a control grid are often greater than that required for typical applications of the electron gun. In this embodiment, the same space charge forces that were previously present between the cathode and the anode are now present between the cathode and the control grid. The effect of the anode potential on the space charge between the cathode and control grid is negligible, and, in general, in this embodiment, the self-field of the beam between the control grid and the anode is insignificant.

In another embodiment of the invention, an electron deflecting plate is disposed above the cathode sections and within the cathode assembly to deflect stray electrons, which have been initially emitted in a direction away from the anode assembly, back toward the anode assembly. This increases the overall useful emission of the cathode structures.

In a still further embodiment of the invention, imaging grids are disposed between the cathode assembly and the anode assembly to align the accelerated electron trajectories so that a minimal number of accelerated electrons are absorbed by obstructions located at the anode assembly.

It is, therefore, an object of this invention to provide a broad beam electron gun having a plurality of cathodes without requirement for a shaping grid.

It is a further object of this invention to provide an improved broad beam electron gun having a cathode assembly comprising an array of hair-pin shaped cathodes.

It is a still further object of this invention to provide an improved broad beam electron gun having a cathode assembly comprising an array of hair-pin shaped cathodes, and also having a generally planar current regulation grid for regulating the current densities emitted by the electron gun.

It is another object of the present invention to provide an improved broad beam electron gun having a cathode assembly comprising an array of hair-pin shaped cathodes, wherein the cathodes are operated in a space-charged limited mode.

It is still another object of the present invention to provide an improved broad beam electron gun having a cathode assembly comprising an array of cathode sections having the shape of cylinders or coils.

It is a further object of this invention to provide an improved broad beam electron gun having a cathode assembly comprising an array of cathode sections with electron emissive surfaces which are positioned so that a substantially hemispherically-shaped space-change distribution is formed.

The foregoing and other objects, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
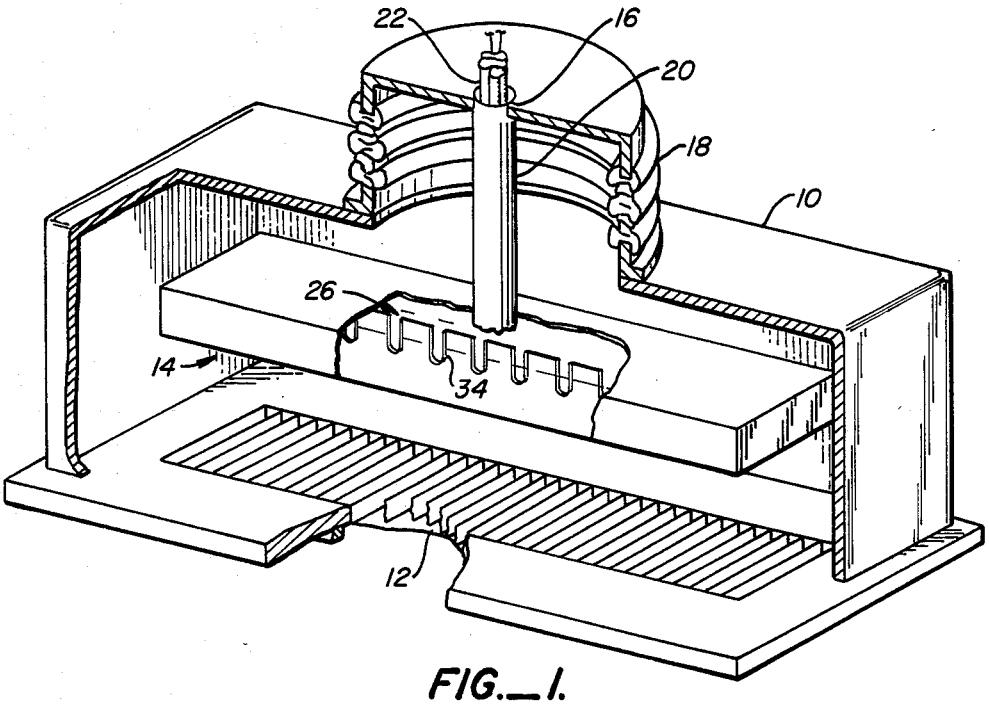
FIG. 1 is a prospective cross-sectional view of the present invention.

Referring more particularly to FIG. 1, the improved broad beam electron gun will be generally described. The basic broad beam electron gun includes a vacuum housing 10, an anode 12 which is generally transparent to electrons, a cathode assembly 14, and means for applying an electrical potential between the cathode assembly and the anode. The electrical potential applying means 16, in this embodiment, comprise an electrical insulator 18 having a vacuum-tight feed-through 20 through which conductors 22 can be routed for connection between an external source of negative high voltage potential (not shown) and the cathode assembly 14 within the housing 10.

Located within the cathode assembly 14 of the preferred embodiment is an array of hair-pin shaped cathodes. The major axis of symmetry 25 of each hair-pin shaped cathode 34 is orthogonal to the plane of the anode 12. As shown in FIG. 1, in this particular embodiment, the hair-pin shaped cathodes are joined together to form a row 26 extending the length of the cathode assembly. The row is substantially parallel with, but spaced apart from, the electron-transparent anode 12. Depending upon the cross-sectional area of the beam required, a single hair-pin cathode may be sufficient.

Figure 2:
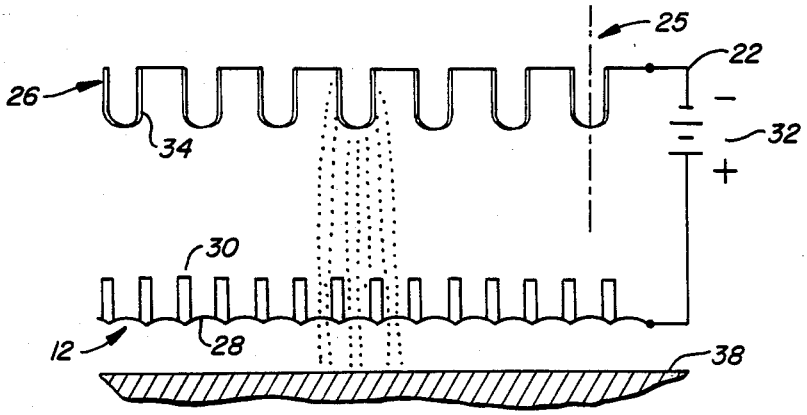
FIG. 2 is a simplified, graphic representation of the basic elements of the present invention.
Figure 3:
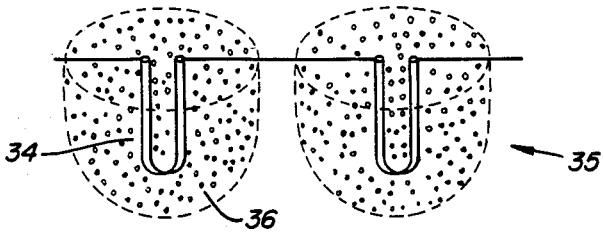
FIG. 3 is a simplified depiction of electron distribution obtainable with a hair-pin shaped cathode.

Referring now to FIGS. 2 and 3, the electrical operation of the present invention will be described. FIG. 2 illustrates the longitudinally extending row 26 of hair-pin cathodes. The electron transparent anode 12 comprises a thin electron transparent sheet 28 disposed over parallel support ribs 30.

An electrical potential 32 from an external source is applied between the cathode row 26 and the anode 12. The cathodes 34 are heated by an external source (not shown). Electrons emerging from the hair-pin cathodes 34 are drawn off by and accelerated toward the anode 12 by the electrical potential 32. The hair-pin shape of the cathode 34 causes electrons to be emitted in a hemispherically-shaped pattern toward the anode 12 without the need for a shaping grid. Since the anode 12 is generally transparent to electrons, the electrons, after reaching the anode 12, will pass through the anode and on to a target 38.

As discussed above, numerous problems are attendent the use of long-elongated filaments, including thermal expansion effects and power requirements. Shorter lengths of an elongated filament are unsatisfactory because of insufficient electron emission in the area near the ends of the filament and parallel to the axis of the filament.

In the present invention, shaping grids are unnecessary and short filament lengths are used. Thus, the operating power requirements are lower, and thermal effects are greatly reduced.

In the preferred embodiment of the present invention, the use of a hair-pin shaped cathode predisposes the emission of electrons so that the emission takes the form of a hemisphere without the need for a shaping grid. That is, the hair-pin shape of the cathode 34 causes a substantial proportion of the electron emitting surface of the cathode to be disposed in a direction which is generally perpendicular to the anode 12. This causes a greater number of emitted electrons to have velocity component parallel to, or in the general direction of, the anode 12 than in the case where an elongated filament is used. As a result, a shaping grid is not required; hence a shaping electrical potential between the cathodes and the shaping grid is not required, and the associated control and mounting apparatus for the shaping grid are not required. Additionally, because a shorter filament can be used, power requirements are reduced. As a result, the cost and complexity of the broad beam electron gun are greatly reduced.

FIG. 3 is a simplified illustration of the emitted electron distribution 36 obtained when hair-pin shaped cathodes 34 are used. Because of the shape of the cathode, electrons will be emitted in an outward and downward direction and will create an electric potential distribution resembling a hemisphere, as indicated by dotted lines 35.

As previously discussed, the cathodes of the present invention are operated in a "space charge limited" mode. As such, unlike those prior broad beam electron guns which were operated in a non-space charge limited mode, it is the anode voltage (or electrical potential 32) rather than electron emission from adjacent cathodes which determine the density of electrons at the anode plane. In a "space charge limited" mode, electrons which have been emitted from and which occupy the space adjacent to a particular cathode, generate a field which acts to counter the electric field of the anode. In the "space charge limited" mode this "space charge" field is large enough to fully counter the anode electric field. As electrons are removed by the anode voltage from the space charge surrounding the cathode they are immediately replaced by electrons from the cathode. Any electrons emitted from the cathode, which are in excess of that which are required to maintain the "space charge" field, are deflected back into the cathode. An increase in the anode voltage increases the number of electrons required to maintain a space charge limiting field, and hence the current density which flows to the anode.

Because, in the space charge limited mode the emission of the electrons is a function of the anode-cathode electric field, precise geometries need not be maintained. Operation of the cathode in the "space charge limited" mode also tends to permit self-correction. That is, should the emission from a particular cathode be deficient for some reason, electrons emitted from the other cathodes will tend to compensate for such deficiencies and, thereby, maintain a uniform beam intensity.

Means for providing each cathode 34 with current for heating the cathode to a state of thermionic emission can be implementated in several ways. One configuration is to tie each cathode, within the row, together in series. This configuration is illustrated in FIG. 2. In this configuration, current is supplied at one end of the row and exits from the other end of the row. Another configuration could be to supply current to each cathode 34 individually.

Figure 4:
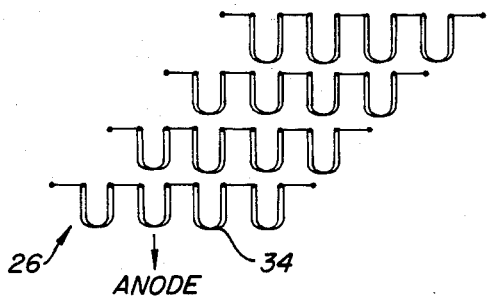
FIG. 4 is a perspective view of an alternative arrangement of the cathode filament sections.
Figure 5:
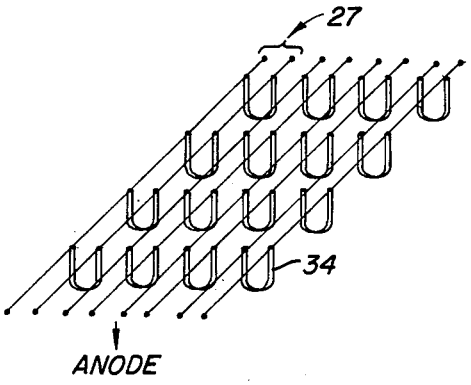
FIG. 5 is a perspective view of another alternative arrangement of the cathode filament sections.

While in the above described embodiment all of the cathode filament sections are contained in a single hypothetical plane which is parallel to the general direction of electron travel; i.e., perpendicular to the plane of the anode, in other embodiments the sections could be contained in a plurality of such parallel planes, as illustrated in FIG. 5, wherein a row of cathodes disposed in a plurality of parallel hypothetical planes is shown. Here several of these parallel plane rows 27 are shown positioned substantially parallel to one another. A number of these parallel plane rows 27, FIG. 5, or a number of the single plane rows 26, FIG. 4, can be used to increase the beamwidth of the electron gun.

There are numerous means for heating the hair-pin cathodes and the above-mentioned configurations are not intended to limit such means.

Figure 6:
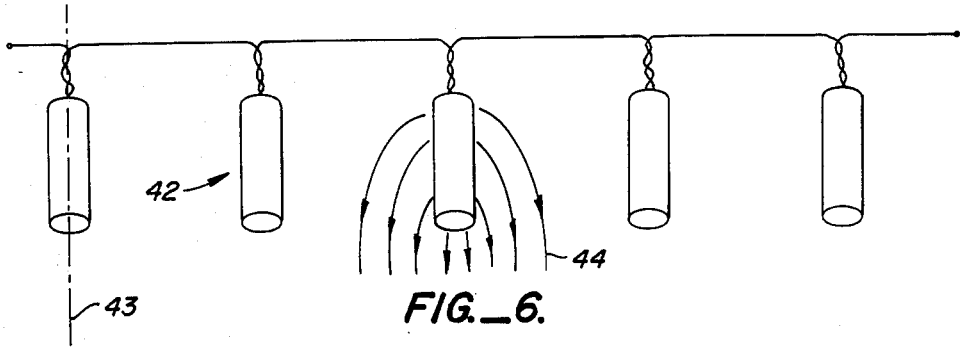
FIG. 6 is a perspective view of an alternative cathode configuration, having the shape of a cylinder, and including a simplified depiction of electron emissions therefrom.

As discussed above, hair-pin shaped cathodes are not the only cathode shapes which permit satisfactory broad beam characteristics. As long as the cathode configuration used provides electron emission surface such that a substantial number of emitted electrons will be predisposed to have a substantial initial velocity transverse to the anode electric field, such cathode configuration would be satisfactory. FIG. 6 illustrates the use of cylindrical shaped cathodes 42. Each cylinder is disposed so that its longitudinal axis is perpendicular to the anode 12. Lines 44 illustrate the electron trajectories from such configuration.

Figure 7:
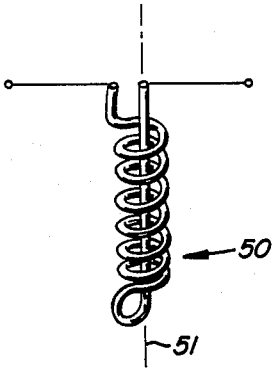
FIG. 7 is a perspective view of a still further alternative cathode configuration, comprising a coiled filament.

FIG. 7 illustrates another alternative cathode configuration. This coiled cathode 50 is similar to the cylindrical cathodes 42 of FIG. 6 above. The principal electron emissive surfaces of a coiled cathode configuration are located on the outwardly or inwardly disposed surfaces of the coil. For the surfaces on the inside of the coil, the electron build-up in the interior of the coil will form an electron repulsive field, which repells most electrons emitted from the inwardly disposed coil surfaces. However, these electrons will be repelled between the loops of the coils and to the exterior of the coil with an initial velocity which is transverse to the electric field, thus contributing to the electron emissions from the coil structure. As such, this configuration takes on the electron emission characteristics of the cylindrical configuration in FIG. 6. When examined in total, the principal electron emissive surfaces of a coiled configuration are located in a hypothetical cylindrically-shaped surface having an axis of revolution which is coincident to the major axis of the coiled cathode. The major axis of symmetry 51 of the coiled cathode, when disposed in the preferred mode, is orthogonal to the plane of the anode assembly 12.

The above various cathode shapes can be used individually or in arrays, depending upon the total current and the beamwidth required.

Figure 8:
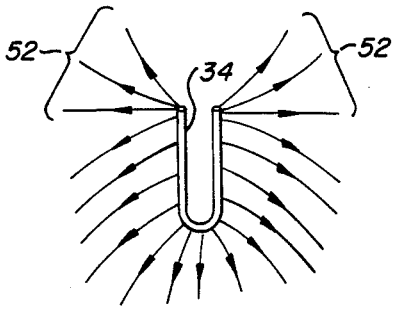
FIG. 8 is a simplified depiction of electron emission from a hair-pin shaped cathode.

Although, when a hair-pin shaped cathode or any of the above alternative cathodes is used, electron emissions are generally predisposed to travel in a path directed toward the anode 12, there is nevertheless a small proportion of electrons which are emitted in a direction away from the anode 12. In FIG. 8, these stray electrons are depicted by lines 52. These stray electrons represent wasted power, and a decrease in electron gun efficiency.

Figure 9:
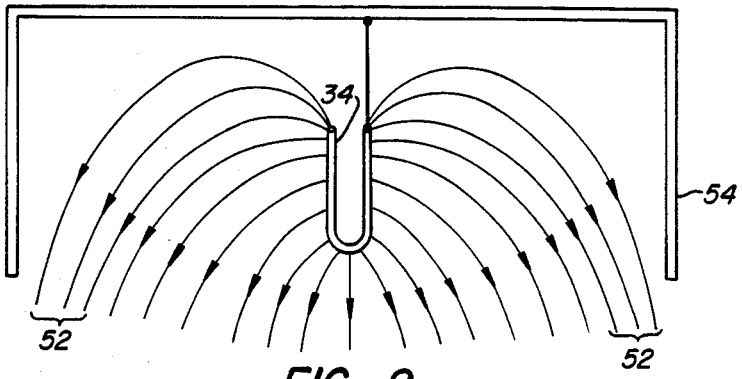
FIG. 9 is a simplified depiction of electron emission from a hair-pin shaped cathode when a deflecting plate is disposed above the cathode.

FIG. 9 illustrates a deflecting plate 54 which can be disposed generally above a cathode 34 and connected so that the cathode 34 and the deflecting plate 54 are at the same electrostatic potential so that the stray electrons 52 are deflected back toward the anode 12.

Figure 10:
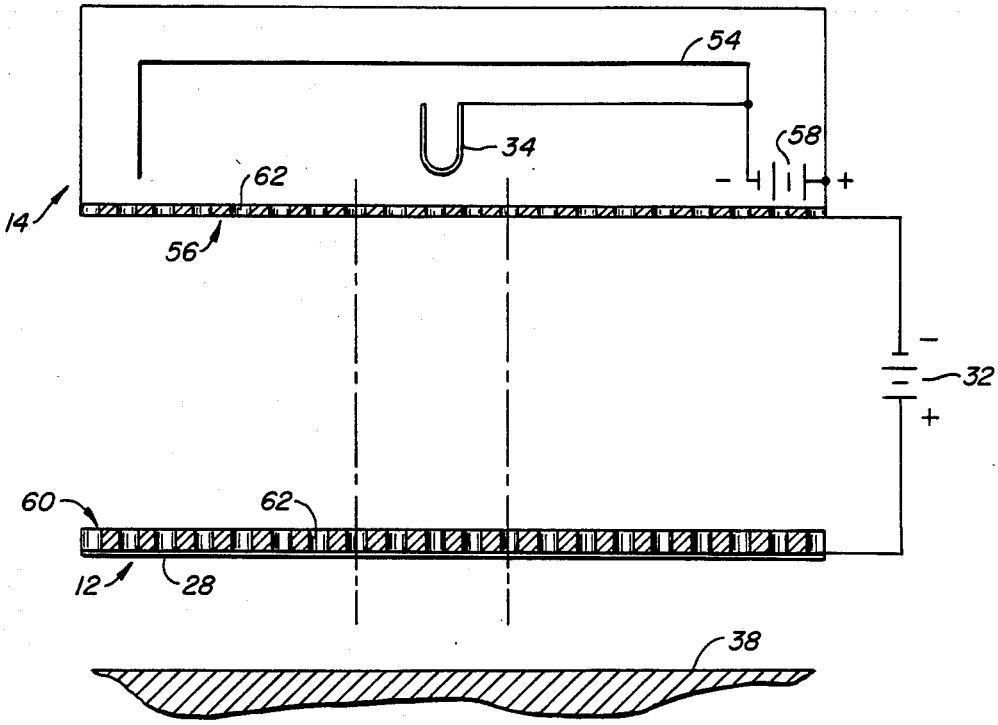
FIG. 10 is a simplified, graphic representation of the present invention, including a rear electron deflecting plate and imaging grids.
Figure 11:
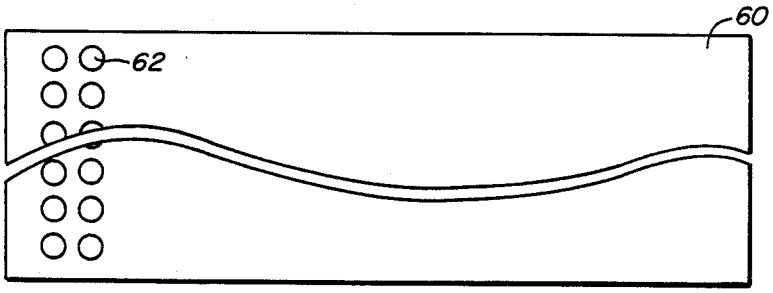
FIG. 11 is a simplified depiction of one of the imaging grids.

FIG. 10 illustrates a further embodiment of the present invention. Typically, when an electron gun is operated according to the configuration shown in FIG. 2, the beam intensity will be very large. In such a configuration, the electrostatic potential 32 can be varied to provide minimal control over the current density. When smaller current densities are required, a generally planar control grid can be inserted between the cathodes 34 and the anode 12. Such a control grid 56 is shown in FIG. 10. The control grid 56 partially counteracts the influence of the anode electrostatic field 32 upon the cathodes 34. The control grid 56 is at a potential which is positive with respect to the cathode 34, and negative with respect to the anode 12. This potential 58 is small with respect to the anode electrostatic potential 32. The control grid 56 can comprise a screen, an apertured conductive sheet, or a number of other possible configurations.

When a control grid 56 is used, it is the electrical potential 58 between the control grid 56 and the cathodes 34 which influence the space charge forces or self-fields between the emitted electrons. The self-fields in the region between the control grid 56 and the anode 12 have insignificant influence on electron distribution. The control grid 56 and associated electrical potential 58 can, therefore, be used to control the beam current density, while the anode electrostatic potential 32 controls the level to which the electrons are accelerated.

The effect of this control grid upon the cathode emissions is to control the number of electrons emitted from the cathodes 34 by regulating the space charge distribution or current density at which the cathodes will reach a "space charge limited" mode. As discussed above, a "space charge limited" mode is obtained when the field generated by electrons immediately adjacent to the cathode 34 fully counteracts the applied electric field, in this case the cathode-control grid potential 58. Because the cathode-contol grid potential 58 determines the electric field seen by the cathodes 34, it determines the number of electrons adjacent to the cathodes which will be required to maintain the space charge limiting field. The fewer the number of electrons required, the lower the current density which will flow through the control grid, to and through the anode 12.

FIG. 10 also illustrates the use of imaging grids to align the trajectories of the electrons emitted from the cathode assembly 14 so that a greater number of electrons which are emitted through the electron window 28, and fewer electrons are absorbed by obstructions, such as the anode support ribs 30, FIG. 2, contained in the window. The above imaging is accomplished through the use of matching grids 56 and 60. Grid 56 is the control grid as discussed above which comprises an apertured conductive sheet. Grid 60 is used in place of the anode support rib structure 30. Each grid is a conductive sheet having a number of apertures 62. Alternatively, grid 60 can be an apertured conductive plate. The aperture pattern for grid 56 is identical to that for grid 60, and the aperature size for grid 56 can be smaller than or equal to the aperture size in grid 60. FIG. 12 is a top view of the grid 60, having apertures 62.

Grid 56 is positioned above grid 60 so that the apertures 62 in each are aligned. Grid 60 is positioned to support the anode window 12. In operation, electrons are emitted from the cathode 34 and accelerated toward grid 56. Electrons having trajectories in a substantial downward direction and which trajectories fall within any of the apertures 62 of the grid 56, will be permitted to pass through the grid 56. Electrons having other trajectories will be absorbed by the grid 56. In this manner, the electrons which are permitted to pass through grid 56 will have trajectories which are substantially perpendicular to the anode window, and which are aligned with the apertures 62 of grid 60. Most of the electrons which have been allowed to pass through grid 56 will pass through the apertures of grid 60 and through the anode window 12, unobstructed. A few of the electrons will be absorbed by the grid 60. By decreasing the size of the apertures in grid 56, while maintaining the alignment between grids 56 and 60, the dispersion of the electron beam as it traverses between the grids can be compensated for so that substantially all of the electrons passing through grid 56 will pass through grid 60.

The efficiency of the broad beam electron gun is improved in the above manner, since the initial imaging of the electron trajectories is accomplished by grid 56 at a low accelerating voltage 58 and low power dissipation. The electrons which were absorbed by grid 60 at a high accelerating voltage are substantially fewer in number and, hence, represent a small amount of wasted energy.

Without imaging grids 56 and 60, the distribution of electrons will be uniform across the anode window 12. As such, the electrons which have been accelerated by the large electrostatic potential 32 will be absorbed by ribs 30 or emitted through the anode window 12 with equal likelihood, thus wasting a large amount of power.

Reference is made to the above-mentioned Farrell patent for specific details on cathode assembly 14 support, transparent anode 12, and other specific details necessary for the implementation of the broad beam electron gun, but which are not a part of the present invention. To this extent the Farrell patent is incorporated herein by reference.

The terms and expressions which have been employed here are used as terms of description and not of limitations, and there is no intention, in the use of such terms and expressions of excluding equivalents of the features shown and described, or portions thereof, it being recognized that various modifications are possible within the scope of the invention claimed.

What is claimed is:

1. An improved broad beam electron gun of the type having a generally planar anode assembly which is generally transparent to accelerated electrons, a cathode assembly, which is arranged parallel to and spaced apart from the anode assembly to form an unobstructed chamber between the cathode assembly and the anode assembly, means for creating an electrostatic potential between the anode assembly and the cathode assembly to accelerate electrons from the cathode assembly toward and through the anode assembly, and an evacuated housing, of which the anode assembly forms one wall, surrounding the cathode assembly, wherein the improvement comprises cathode means, which are operated in a space-charge-limited mode and which are positioned within the cathode assembly, for generating a substantially hemispherically shaped space-charge distribution, the cathode means including an electron emitting structure having a major axis of symmetry and principal electron emissive surfaces which are positioned to collectively extend parallel to and to be spaced equidistant from the major axis of symmetry of the electron emitting structure, the major axis of symmetry being orthogonal to the plane of the anode.

2. An improved broad beam electron gun as recited in claim 1, wherein a plurality of electron emitting structures are positioned so that the major axis of symmetry of each are contained in a single plane which is perpendicular to the plane of the anode assembly.

3. An improved broad beam electron gun as recited in claim 1, wherein a plurality of electron emitting structures are positioned so that the major axis of symmetry of each are contained in separate, parallel planes which are perpendicular to the plane of the anode assembly.

4. An improved broad beam electron gun as recited in claim 1 wherein a number of parallel planes which are perpendicular to the plane of the anode assembly each contain the major axis of symmetry of a plurality of electron emitting structures.

5. An improve broad beam electron gun as recited in claim 1 wherein the electron emitting structure comprises a cathode filament section which is concave and forms a tip, and with the tip pointing toward the anode assembly.

6. An improved broad beam electron gun as recited in claims 1, 2, 3, 4, or 5 wherein the cathode filament sections are each in the shape of hair pins.

7. An improved broad beam electron gun as recited in claims 1, 2, 3, 4 or 5 wherein the cathode filament sections each have the shape of a narrow "u".

8. An improved broad beam electron gun, as recited in claims 1, 2, 3 or 4 wherein the electron emitting structure is in the shape of a cylinder.

9. An improved broad beam electron gun, as recited in claims 1, 2, 3 or 4 wherein the electron emitting structure is in the shape of a coil.

10. An improved broad beam electron gun, as recited in claim 1, which further includes a deflecting plate disposed generally above the cathode means in a plane parallel to the anode assembly, the deflecting plate having the same electrostatic potential as the cathode means.

11. An improved broad beam electron gun, as recited in claims 1, 2, 3, 4 or 10, which further includes a generally planar control grid disposed parallel to and between the cathode assembly and the anode assembly, and wherein the control grid has a potential which is positive with respect to the cathode means and negative with respect to the anode assembly, and further wherein the space-charge-limited mode of the cathode means is a function of the electrical potential between the cathode means and the control grid, so that a change in the potential between the control grid and the cathode means results in a corresponding change in the electron beam intensity, while a change in the potential between the control grid and the anode has little effect upon the beam intensity.

12. An improved broad beam electron gun, as recited in claim 11, wherein the control grid comprises a generally planar conductive sheet having a plurality of apertures, and further including a second generally planar conductive sheet having a plurality of apertures aligned with the apertures of the control grid, the second sheet being positioned to support the anode assembly in a plane parallel to the anode assembly and having a potential equal to the anode assembly, the second sheet also being positioned so that the apertures of the control grid and the second sheet are aligned.

13. An improved broad beam electron gun of the type having a generally planar anode assembly which is generally transparent to accelerated electrons, a cathode assembly which is arranged parallel to and spaced apart from the anode assembly to form an unobstructed chamber between the cathode assembly and the anode assembly, and an evacuated housing, of which the anode assembly forms one wall, surrounding the cathode assembly, wherein the improvement comprises cathode means, which are operated in a space-charge-limited mode and which are positioned within the cathode assembly, for generating a substantially hemispherically shaped space-charge distribution, the cathode means including a cathode filament section which is concave and forms a tip, and with the tip pointing toward the anode assembly to provide principal electron emissive surfaces which are positioned generally perpendicular to the anode assembly;

a generally planar control grid disposed parallel to and between the cathode assembly and the anode assembly; and means for creating a first electrostatic potential between the anode assembly and the control grid by which electrons from the control grid are accelerated toward and through the anode assembly, and for creating a second electrostatic potential between the control grid and the cathode means, to control electron beam intensity from the cathode means through the control grid, the space-charge limited operation of the cathode means being a function of the second electostatic potential, so that a change in the second electrostatic potential results in a corresponding change in electron beam intensity, while a change in the first electrostatic potential has little effect on the electron beam intensity.

14. An improved method for generating a broad beam of electrons including the steps of enclosing a cathode assembly in an evacuated housing, positioning a generally planar anode assembly which is generally transparent to accelerated electrons to form one wall of the housing so that the anode assembly is parallel to and spaced apart from the cathode assembly, applying a first electrostatic potential between the anode assembly and the cathode assembly so that electrons are accelerated from the cathode assembly toward and through the anode assembly, and regulating the electrostatic potential so that the cathode assembly is operated in a space-charge limited mode, wherein the improvement comprises the step of forming principal electron surfaces in the cathode assembly which collectively extend substantially orthogonally to the planar anode assembly so as to produce a substantially hemispherically-shaped space-charge distribution in the cathode assembly before the electrons are accelerated by the first electrostatic potential.

* * * * *